United States Patent [19]

Kobayashi

[11] Patent Number: 4,818,220

[45] Date of Patent: Apr. 4, 1989

[54] GAS CUTTING TORCH

[75] Inventor: Souji Kobayashi, Kawaguchi, Japan

[73] Assignee: Taseto Co., Ltd., Japan

[21] Appl. No.: 57,777

[22] Filed: Jun. 3, 1987

[30] Foreign Application Priority Data

Jun. 4, 1986 [JP] Japan ..... 61-130891

[51] Int. Cl.[4] ..... F23Q 3/00; F23D 14/82

[52] U.S. Cl. ..... 431/264; 431/278; 431/346

[58] Field of Search ..... 431/255, 264, 278, 346; 266/48

[56] References Cited

U.S. PATENT DOCUMENTS

| | | | |
|---|---|---|---|
| 1,176,017 | 3/1916 | Armstrong . | |
| 1,290,422 | 1/1919 | Vale et al. . | |
| 2,095,747 | 10/1937 | Jacobsson . | |
| 3,031,285 | 4/1962 | Hedberg . | |
| 3,035,632 | 5/1962 | Ericsson | 431/346 X |
| 3,220,459 | 11/1965 | Wilson | 431/255 |
| 3,243,272 | 3/1966 | Schmitz . | |
| 3,280,881 | 10/1966 | Hach, Jr. et al. | 431/255 |
| 3,436,164 | 4/1969 | Deucher | 431/255 |
| 3,694,134 | 9/1972 | Ross | 431/255 |
| 4,348,172 | 9/1982 | Miller | 431/255 |

FOREIGN PATENT DOCUMENTS

| | | | |
|---|---|---|---|
| 1211563 | 3/1966 | Fed. Rep. of Germany | 431/346 |

*Primary Examiner*—Randall L. Green

*Attorney, Agent, or Firm*—McGlew & Tuttle

[57] ABSTRACT

A gas cutting torch for the fusion-cutting such iron materials as steel frames or iron plates by dint of flames, is equipped with a pilot fire port in the vicinity of a main cutting tip. A fire is set to this pilot fire port by means of an ignition unit. A fire is set to the main cutting tip by the pilot flame which has been formed on the pilot fire port. So that the pilot fire port functions as an automatic ignition service against the main cutting tip.

4 Claims, 3 Drawing Sheets

GAS CUTTING TORCH

BACKGROUND OF THE INVENTION

This invention relates to a gas cutting torch for fusion-cutting the iron materials like steel frames and iron plates by jetting out of the main cutting tip the mixed gas obtained by mixing gas and oxygen for igniting it, and thus by utilizing the main flame which has been formed on the main cutting tip.

This type of gas cutting torch adopts conventionally the way of setting a fire by utilizing a separately installed ignition device or lighter.

The reason for it is to design the gas cutting torch in a lighter-in-weight and compacter-in-size version and to alleviate an operator's fatigue or to reduce the operators inconvenience because, in case of a manual gas cutting torch, the operator holds it in one of his hands and performs the fusion cutting work while moving the torch at his disposal.

However, in case of the gas cutting torch, there is a need for extinguishing the fire from time to time during its usage, and it is troublesome to reset a fire using a lighter on each of such occasions. Moreover, holding the gas cutting torch in one hand and handling the lighter with the other hand at a high platform, for example at the construction on-site for a building or a bridge may involve a danger for the operator to fall down from it since both his hands are occupied.

SUMMARY OF THE INVENTION

The invention makes it possible to automatically set a fire of a gas cutting torch, without using a lighter; to a gas cutting torch.

BRIEF DESCRIPTION OF THE DRAWINGS

The embodiment example of this invention can further be known into details with reference to FIG. 1 through FIG. 7.

DETAILED DESCRIPTION

Figure 1:
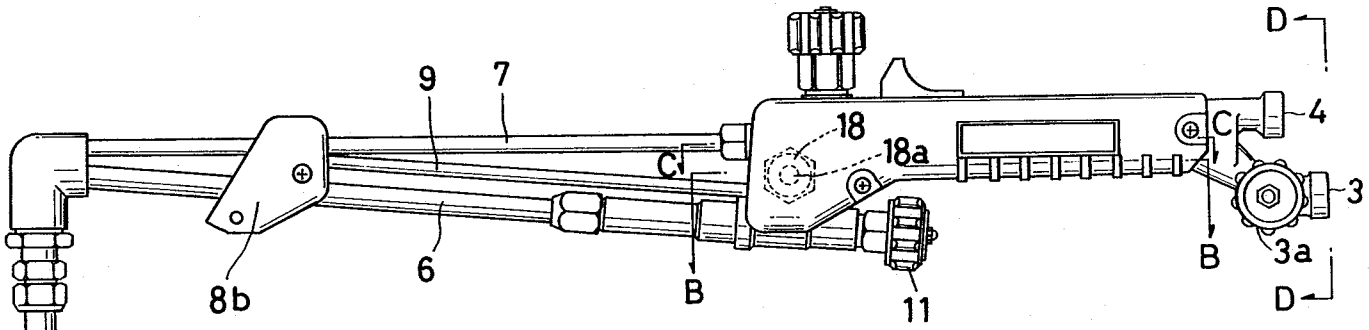
FIG. 1 is a side elevational view of a gas cutting torch equipped with the device for automatically setting a fire.
Figure 2:
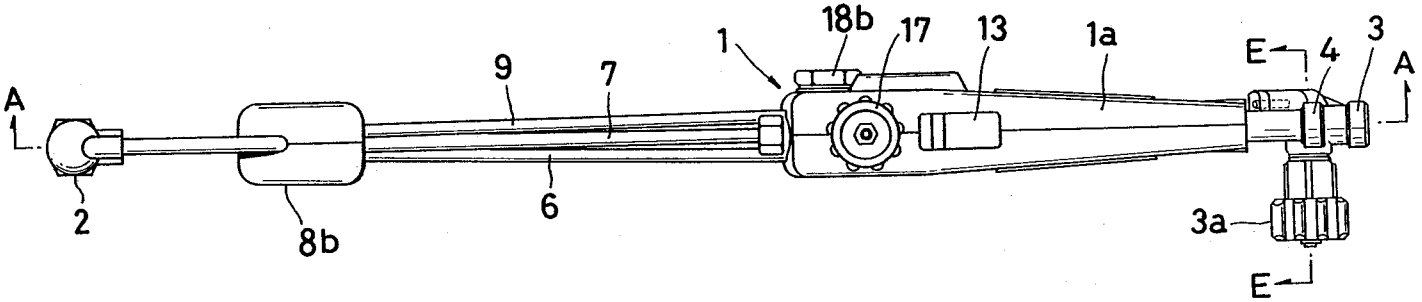
FIG. 2 is a top plan view of the gas cutting torch shown in FIG. 1.

A pilot fire port 8 for the automatic ignition service in this invention is installed in a nozzle or neighbourhood of the main cutting tip 2 while the ignition unit 15 for setting a fire to the pilot fire port 8 as well as its control section are mounted in a vicinity of the handle section 1*a*.

A gas cutting torch main body 1, which can be held in one hand by gripping the handle section 1*a*.

The main cutting tip 2 is supported by a gas pipe 6 and an oxygen pipe 7 both extending forward from the handle section 1*a*.

Figure 3:
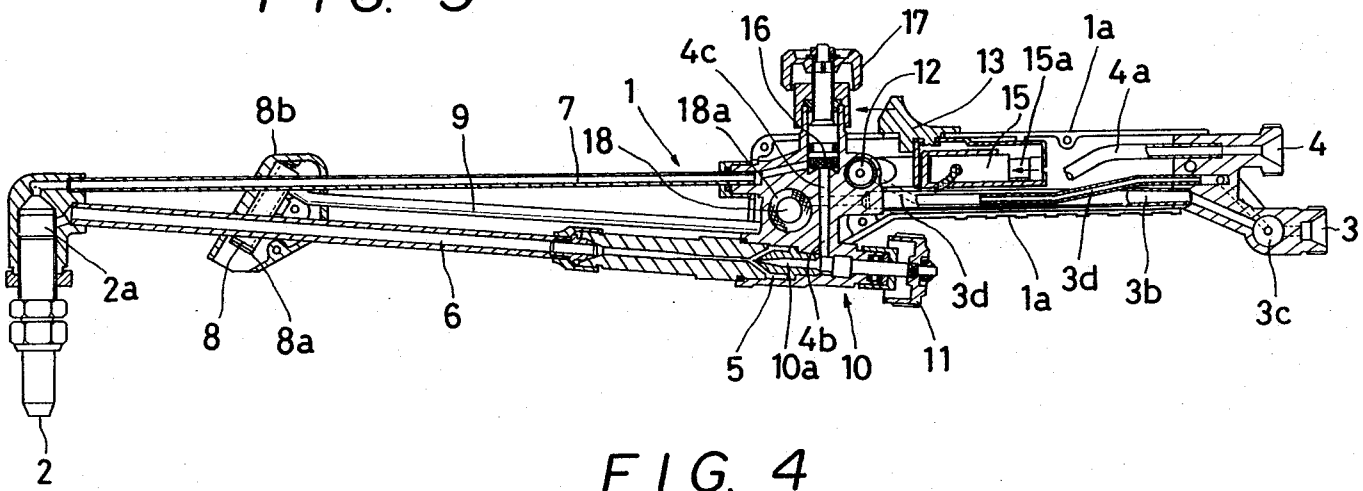
FIG. 3 is a sectional view taken along the line A—A line of FIG. 2.
Figure 4:
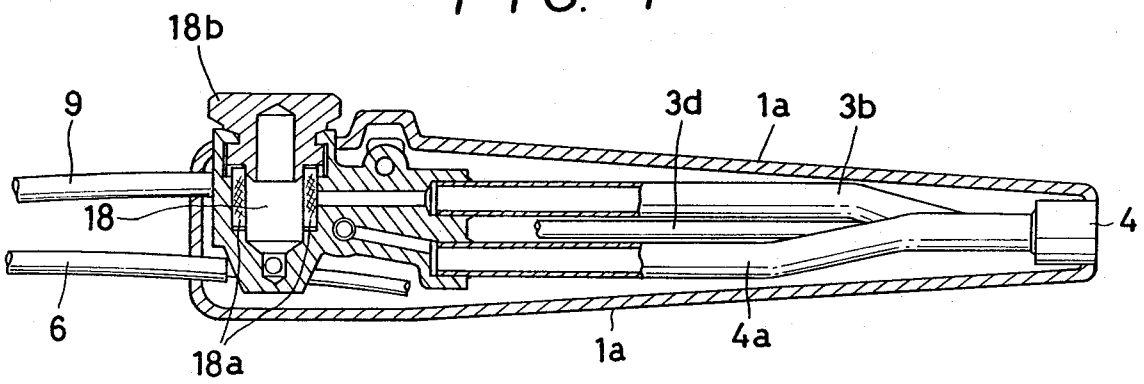
FIG. 4 is a sectional view taken along the line B—B of FIG. 1.
Figure 5:
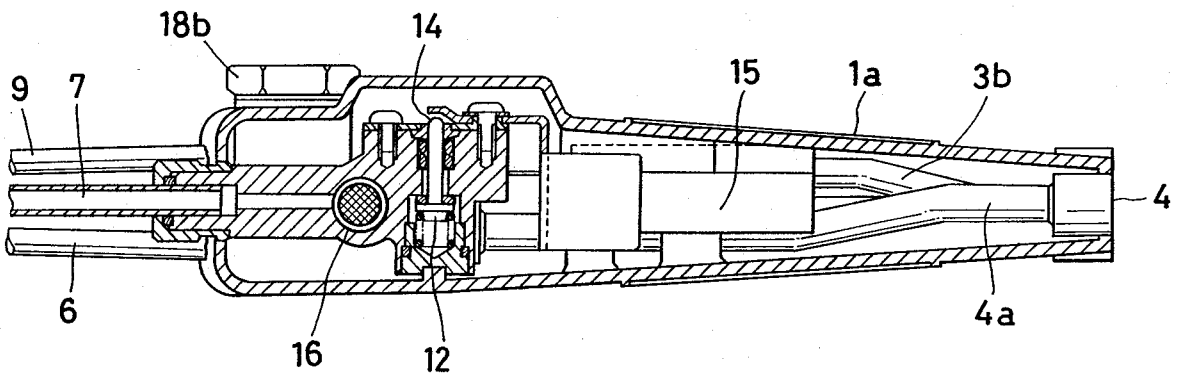
FIG. 5 is a sectional view taken along the line of C—C of FIG. 1.
Figure 7:
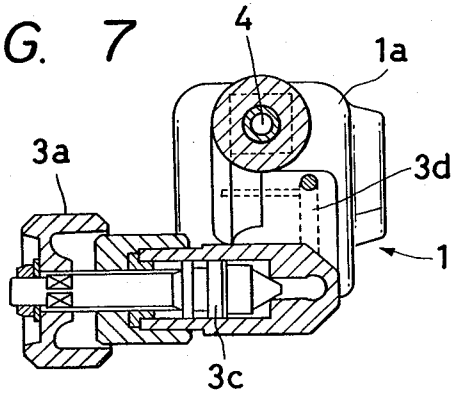
FIG. 7 is a sectional view taken along the line E—E of FIG. 2.
Figure 6:
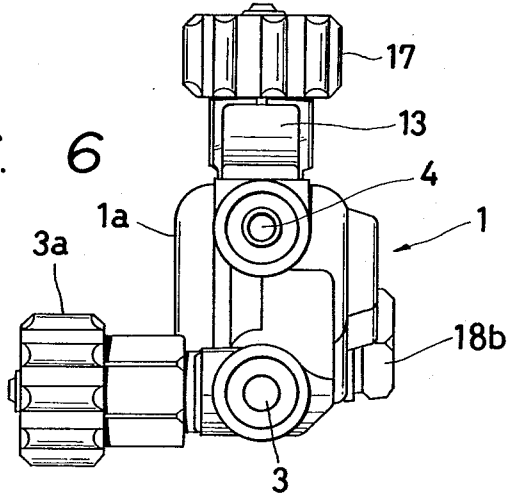
FIG. 6 is a front elevational view; the direction of the line D—D.

In FIG. 3, a mixture section 2*a* of gas with oxygen is built up inside the main cutting tip 2; mixed gas and oxygen which have entered into the main cutting tip 2 from the mixed gas pipe 6 and the oxygen pipe 7 are further mixed in the mixture section 2*a*. However, at the time of heating a metal material, only the mixed gas jets out of the tip of main cutting tip 2.

A gas supply port 3 is provided at to the rear edge of handle section 1*a* and it has a gas supply valve 3c which is controlled by a knob 3*a*. An oxygen supply port 4 is also located at the handle section 1a.

A mixture chamber 5 of gas with oxygen located inside the front area of handle section 1*a*, and the gas which has entered inside the handle section 1*a* from the gas supply port 3 passes through a back-fire or flashback preventive unit 18, which is to be described later, via a gas passage 3*b* and enters into this mixture chamber 5. Oxygen which has entered from the oxygen supply port 4 passes through the oxygen passage 4*a* inside the handle section 1*a* and is branched inside the front area of the handle section 1*a*. One branch enters into the needle valve 10 inside the mixture chamber 5 via the branch channel 4*b*, and its volume is adjusted by the needle 10*a*. This branch is mixed with the gas in the mixture chamber 5 and led to the main cutting tip 2 from the mixed gas pipe 6.

The gas which has entered from the gas supply port is branched to the pilot gas passage 3*d* by means of the valve 3*c*. This gas passes through the pilot gas pipe 9 from the pilot gas valve 12 and is led to the pilot fire port 8 which is mounted to the neighbourhood of the main cutting tip 2. The Electrodes 8*a* for spark discharge are installed to the tip of pilot fire port 8, and the pilot fire port 8 is shielded by the cover 8*b*. And a knob is provided for controlling the needle 10*a*.

A piezoelectric ignition service lever 13 extends above to the front upper face of handle section 1*a*, and this ignition lever can be slided to the front side. And if this ignition lever 13 is slid to the front side, the pilot valve 12 is opened and the gas is supplied to the pilot port 8 via the pilot gas pipe 9. At the same time, the piezoelectric ignition unit 15 is actuated for generating a high voltage and discharges electricity in electrodes 8*a*. By this electric discharge, a fire is set to the gas being jetted out of the pilot fire port 8. For reference, the piezoelectric ignition unit is the device utilizing the officially known piezoelectric effect.

An the oxygen valve 16 is installed on the side of another branch channel 4*c* which has branched the oxygen channel 4*a* into the branch channel 4*b*, and this oxygen valve 16 can be opened or closed by means of the knob 17. The downstream side of this valve 16 is interlocked with the oxygen pipe 7.

A back fire preventive unit 18 is situated on upstream of the mixture chamber 5 in the gas passage 3*b* and is incorporated into the front area of handle section 1*a*, in which the back fire preventive device or filter 18*a* made of sintered metal is incorporated. Thi back fire preventive device 18*a* is fitted detachably inside the handle section 1a by the retainer nut 18*b*.

The operation of the gas cutting torch is to be explained below:

First, the gas supply port 3 and the oxygen supply port 4 are connected to the gas and oxygen cylinders respectively using the hoses. When respective valves on the side of cylinders are opened for supplying the gas and the oxygen, the gas and the oxygen are led to the mixture chamber 5 respectively through the gas passage 3*b* and the oxygen channel 4*a*, and they are mixed in this chamber. This mixture ratio is controlled by the opening degree of the needle 10*a* contained in the needle valve 10. On the other hand, the gas which has entered the pilot gas passage 3*d* from the valve 3*c* is stopped by the pilot gas valve 12. The oxygen entering the oxygen channel 4*a* and flowing to the side of oxygen pipe 7 is stopped by the oxygen valve 16.

Next, when the ignition lever 13 is slid to the front side, the pilot gas valve 12 is opened, and the gas is flows to the pilot fire port 8 and also the trip arm 15*a* of piezoelectric ignition unit 15 is actuated, generating a spark discharge between the electrodes 8*a*. As a result, the pilot flame is formed in the pilot fire port 8.

When a fire has been set to this pilot fire port 8, control the knob 11 for opening the needle 10*a* and for mixing the gas with the oxygen, and cause it to flow to the side of main cutting tip 2 via the mixed gas pipe 6. When the mixed gas is jetted out of the main cutting tip 2, a fire is shifted to it from the pilot flame. After this fire shift, when the operators hand is released from the ignition lever 13, this lever is reset automatically by a spring for closing the pilot gas valve 12, and the pilot flame of pilot fire port 8 goes out. Next, the knob 11 is adjusted for the needle valve for mixed gas for adjusting the fire intensity, and carry out the heating work prior to the fusion cutting by use of the main flame which has been formed in the main cutting tip 2.

When the heating work is through, the oxygen valve 16 is opened by use of the knob 17 for sending out a great deal of oxygen against the main cutting tip 2 and for forming a jet flame, or an intensive flame for cutting service, to the main cutting tip 2, and perform the cutting work.

When the work has been completed, all the valves are closed.

Whats more, as the procedure for setting a fire to the main cutting tip 2, it is also acceptable to have the mixed gas first jetted out of the main cutting tip 2 for setting later a fire to the pilot fire port 8, thereby igniting the main cutting tip 2 by use of the said pilot flame.

The pilot fire port is mounted in the neighbourhood of the main cutting tip for forming a pilot flame on this pilot fire port while controlling the one-touch type ignition lever. The ignition can be achieved by forming a pilot flame at the pilot fire port and by shifting a fire to the main fire port through the use of the pilot flame, this invention eliminates the need for using a lighter as necessary in the past in setting a fire and can achieve an enhanced workability and safety.

In addition, this invention can also be applied to so-called automatic type gas cutting torch, which is not a manual, for fusion cutting of metals while moving it mechanically on the fusion cutting line.

What is claimed is:

1. A gas cutting torch comprising a housing providing an elongate hollow handle portion having front and rear ends;

gas and oxygen entry fittings mounted on the rear end;

a manifold block mounted on the front end;

separate passages for gas and oxygen extending through the handle portion connecting the fittings to the manifold block;

gas, oxygen and pilot gas pipes extending forwardly from the manifold block with the gas and oxygen pipes joining at a cutting tip and the pilot gas pipe terminating at an outlet port adjacent but spaced from the cutting tip;

ignition electrodes installed in the outlet port;

the manifold being formed with bores interconnecting the respective gas and oxygen passages and pipes;

first and second chambers in the bores interconnecting the gas passage with the gas pipe, the first chamber being located upstream of the second chamber;

a back-fire preventive device releasably mounted in the first chamber;

the second chamber being a gas mixing chamber and having a gas mixing valve mounted therein;

a further bore connecting the oxygen passage with the gas mixing chamber wherein a gas and oxygen mixture is supplied by the gas mixing chamber to the gas pipe;

a third chamber in the bore interconnecting the oxygen passage and the oxygen pipe, the third chamber having an oxygen jet control valve mounted therein whereby the oxygen jet gas supplied to the oxygen pipe can be adjusted;

a fourth chamber in the bore interconnecting the gas passage with the pilot gas pipe;

a pilot gas control valve being mounted in the fourth chamber; and, a piezoelectric gas ignition device mounted in the handle having an operating button located for longitudinal sliding movement adjacent the manifold block, the pilot gas valve being operable to admit pilot gas to the pilot pipe by movement of the ignition button to an ignition position to supply an ignition spark to the electrodes.

2. A gas cutting torch according to claim 1 wherein:

the manifold block has upper and lower faces, mutually opposite side faces and front and rear faces, the gas and oxygen passages from the handle portion connecting to the manifold block at the rear face and the gas and oxygen pipes connecting to the manifold block at the front face, the first and fourth chambers being formed adjacent the front and rear faces, respectively, the first chamber opening to a lateral face, the second chamber being formed in a lowermost portion of the block;

a valve adjustment knob is mounted in the second chamber to extend rearwardly from the rear face, adjacent the lower face and below the handle; and, a valve adjustment knob is mounted in the third chamber to upstand from the upper face of the block in front of the handle.

3. A gas cutting torch according to claim 1 wherein the back-fire preventive device is made of sintered metal.

4. A gas cutting torch comprising a housing providing an elongate hollow handle portion having front and rear ends;

gas and oxygen entry fittings mounted on the rear end and a gas and oxygen distribution area on the front end;

gas, oxygen and pilot gas pipes extending forwardly from the distribution area with the gas and oxygen pipes joining at a cutting tip, and the pilot gas pipe terminating at an outlet port adjacent but spaced from the cutting tip;

separate passages for gas and oxygen extending through the handle portion to the front end connecting the fittings to the distribution area and then to the gas, oxygen and pilot gas pipes, respectively;

ignition electrodes installed in the outlet port;

first and second chambers in the gas passage connecting to the gas pipe, the first chamber being located upstream of the second chamber;

a back-fire preventive device made of sintered metal releasably mounted in the first chamber;

the second chamber being a gas mixing chamber and having a gas mixing valve mounted therein;

the oxygen passage also connecting with the gas mixing chamber whereby a gas and oxygen mixture is supplied by the gas mixing chamber to the gas pipe;

a third chamber in the passage connecting the oxygen passage to the oxygen pipe, the third chamber having an oxygen jet control valve mounted therein whereby the oxygen jet gas supplied to the oxygen pipe can be adjusted; and a fourth chamber in the gas passage connecting to the pilot gas pipe;

a pilot gas control valve being mounted in the fourth chamber; and, a piezoelectric gas ignition device mounted in the handle having an operating button located for longitudinal sliding movement at the front end of the handle, the pilot gas valve being operable to admit pilot gas to the pilot pipe by movement of the ignition button to an ignition position to supply an ignition spark to the electrodes.

* * * * *